United States Patent [19]

Haller

[11] 3,934,423

[45] Jan. 27, 1976

[54] POWER CYLINDER CONSTRUCTION

[75] Inventor: Roland Haller, Shiloh, Ohio

[73] Assignee: Harsco Corporation, Camp Hill, Pa.

[22] Filed: Mar. 27, 1974

[21] Appl. No.: 455,062

[52] U.S. Cl. ..... 92/52; 92/53; 92/59; 92/62; 92/66; 92/86; 92/169; 92/256

[51] Int. Cl.[2] ..... F01B 7/20

[58] Field of Search ..... 92/51, 52, 53, 62, 66, 92/86, 128, 169, 255, 256, 59

[56] References Cited

UNITED STATES PATENTS

| | | | |
|---|---|---|---|
| 2,364,741 | 12/1944 | Merchant | 92/86 X |
| 2,832,650 | 4/1958 | Park | 92/53 X |
| 3,116,812 | 1/1964 | Farmer et al. | 92/51 X |
| 3,182,563 | 5/1965 | Neilan | 92/164 X |
| 3,279,755 | 10/1966 | Notenboom et al. | 92/53 X |
| 3,415,169 | 12/1968 | Naddell | 92/53 X |
| 3,421,786 | 1/1969 | Panigati | 92/128 X |
| 3,653,302 | 4/1972 | Notenboom | 92/53 |
| 3,722,375 | 3/1973 | Sievenpiper | 92/53 X |
| 3,805,681 | 4/1974 | Wible et al. | 92/52 |
| 3,807,285 | 4/1974 | Phillips | 92/255 |

FOREIGN PATENTS OR APPLICATIONS

| | | | |
|---|---|---|---|
| 209,497 | 11/1956 | Australia | 92/53 |

*Primary Examiner*—Irwin C. Cohen
*Assistant Examiner*—Abraham Hershkovitz
*Attorney, Agent, or Firm*—Palmer Fultz, Esq.

[57] ABSTRACT

A power cylinder of the multiple stage telescoping type that is characterized by a plurality of telescoping piston and cylinder assemblies, each of which comprises a composite cylinder and piston sleeve construction and an end closure construction that provides an extension stop for the piston sleeve of the next adjacent stage. The apparatus is further characterized by a quickly detachable base plate construction which permits ready access to the interior components of the cylinder via the base end thereof.

9 Claims, 4 Drawing Figures

POWER CYLINDER CONSTRUCTION

BACKGROUND OF THE INVENTION

This invention relates to fluid actuated cylinders and more particularly to apparatus of this type that include a plurality of telescoping sections.

PROBLEMS IN THE ART

In the manufacture of telescoping power cylinders of the large industrial type, such as are used on truck dump bodies, there has been the practice in the art to fabricate the telescoping piston and cylinder assemblies from tubular members or uniform thickness throughout their axial length. Also such prior arrangements have been provided with separate stop rings mounted on the confronting cylinder and piston surfaces between each successive stage which stops rings function to limit the axial extension of each successive stage. Such structural arrangements have often been subject to early structural failure due to insufficient intersurface area between the piston and cylinder surfaces, as well as due to failure of the separate stop ring structures.

It has also been the practice in the art to fabricate such cylinders by welding base end plates directly to the cylindrical housing and such mounting practices have presented a problem in that heat imposed distortion of the cylindrical working surfaces has often occurred with resulting distortion of the interior cylindrical working surfaces. Hence remachining of such surfaces after welding has often been required.

Also in such prior power cylinder construction the end closures for the base end and ram end have generally been welded in place making access to the interior of the power cylinder by breaking of the welds relatively difficult when disassembly for servicing and repair becomes necessary.

SUMMARY OF THE INVENTION

In general, the power cylinder of the present invention comprises an outer tubular housing means within which are mounted a plurality of progressively extendable piston and cylinder assemblies arranged in telescoping relationship such that when the device is pressurized the cylindrical members progressively extend from the housing means so as to apply force to the load being actuated.

More particularly, the piston and cylinder assemblies are constructed in a novel manner wherein cylindrical members are provided with external piston sleeves, the latter serving to strongly reinforce the base ends of the cylindrical members to provide relatively large areas of piston to cylinder contact, and also form stop engaging shoulders for limitiing the movement of the assembly. In addition each of the piston and cylinder assemblies includes an end closure for the next successive stage that also functions as a stop for the stop engaging shoulder of the piston sleeve of such next successive stage.

The power cylinder construction further includes a base means for pivotally mounting the cylinder to a base pivot which base means includes a novel structural arrangement that makes possible means for pivotally mounting the cylinder to a base pivot, and includes a novel structural arrangement that makes possible forming a welded junction between the tubular housing means and the base means without causing heat imposed distortion of the cylindrical surfaces of the interior components of the power cylinder.

The components of the apparatus further include unique structure adapted for the rapid assembly and disassembly of the housing base means as well as the above mentioned piston and cylinder assemblies.

It is therefore an object of the present invention to provide improved telescoping power cylinders which include novel piston and cylinder assemblies with increased intersurface contact as well as integral piston stop arrangements of high structural strength.

It is another object of the present invention to provide a novel power cylinder that includes an improved base means construction that can be ruggedly mounted on the device by welding without causing heat imposed distortion of machined surfaces of the internal working components.

It is still another object of the present invention to provide a novel telescoping power cylinder that includes housing base means uniquely adapted for rapid assembly and disassembly.

Further objects and advantages of the present invention will be apparent from the following description, reference being had to the accompanying drawings wherein a preferred form of embodiment of the invention is clearly shown.

DESCRIPTION OF THE PREFERRED EMBODIMENT

Figure 1:
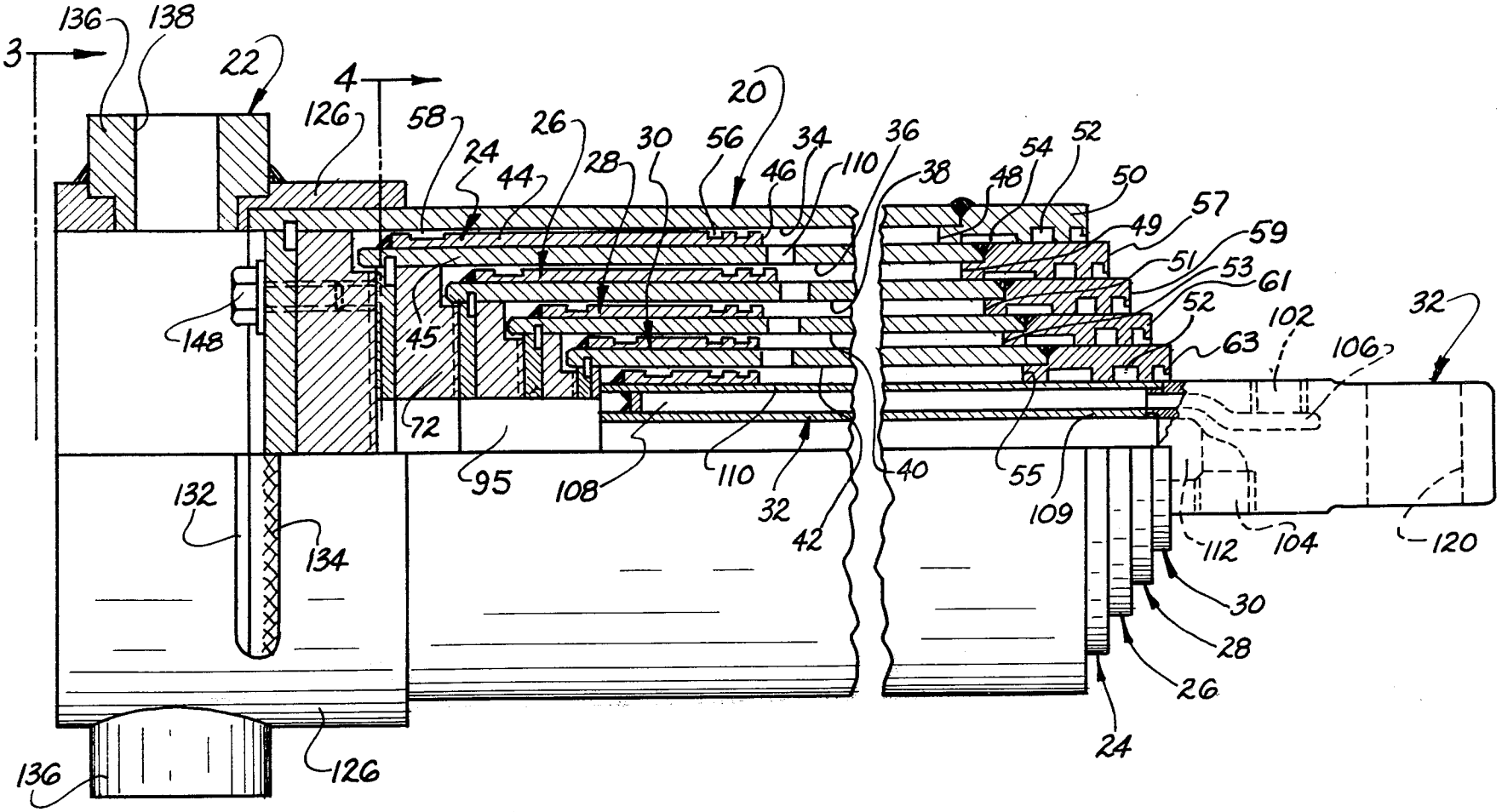
FIG. 1 is a side elevational view, partially in section, of a power cylinder constructed in accordance with the present invention, the section being taken along a vertical plane through the centerline of the apparatus.

Referring in detail to the drawings, FIG. 1 illustrates a power cylinder constructed in accordance with the present invention which comprises an outer tubular housing means indicated generally at 20, and a base means indicated generally at 22, the latter including a unique base plate construction 140–142 removably attached with respect to the housing means in a manner later to be described.

Housing means 20 contains a plurality of piston and cylinder tube assemblies, the first stage being indicated generally at 24. The second, third, and fourth stage tube assemblies are indicated generally at 26, 28, and 30 respectively and a central ram assembly, comprising the fifth stage is indicated generally at 32.

Housing 20 includes an inner cylindrical surface 34 and the cylindrical inner surfaces of the successive stages are designated 36, 38, and 40.

Each of the above mentioned stages includes and outer piston sleeve 44, the end of which comprises ab abutment 46 that is arrested by a respective stop 48, 49, 51, 53, or 55 provided by permanently attached end caps 50, 57, 59, 61, or 63, the latter including seals 52 and internal wear rings 54.

It should be mentioned that the annular piston sleeves 44 are provided with seals 56 and wear rings 58.

Figure 2:
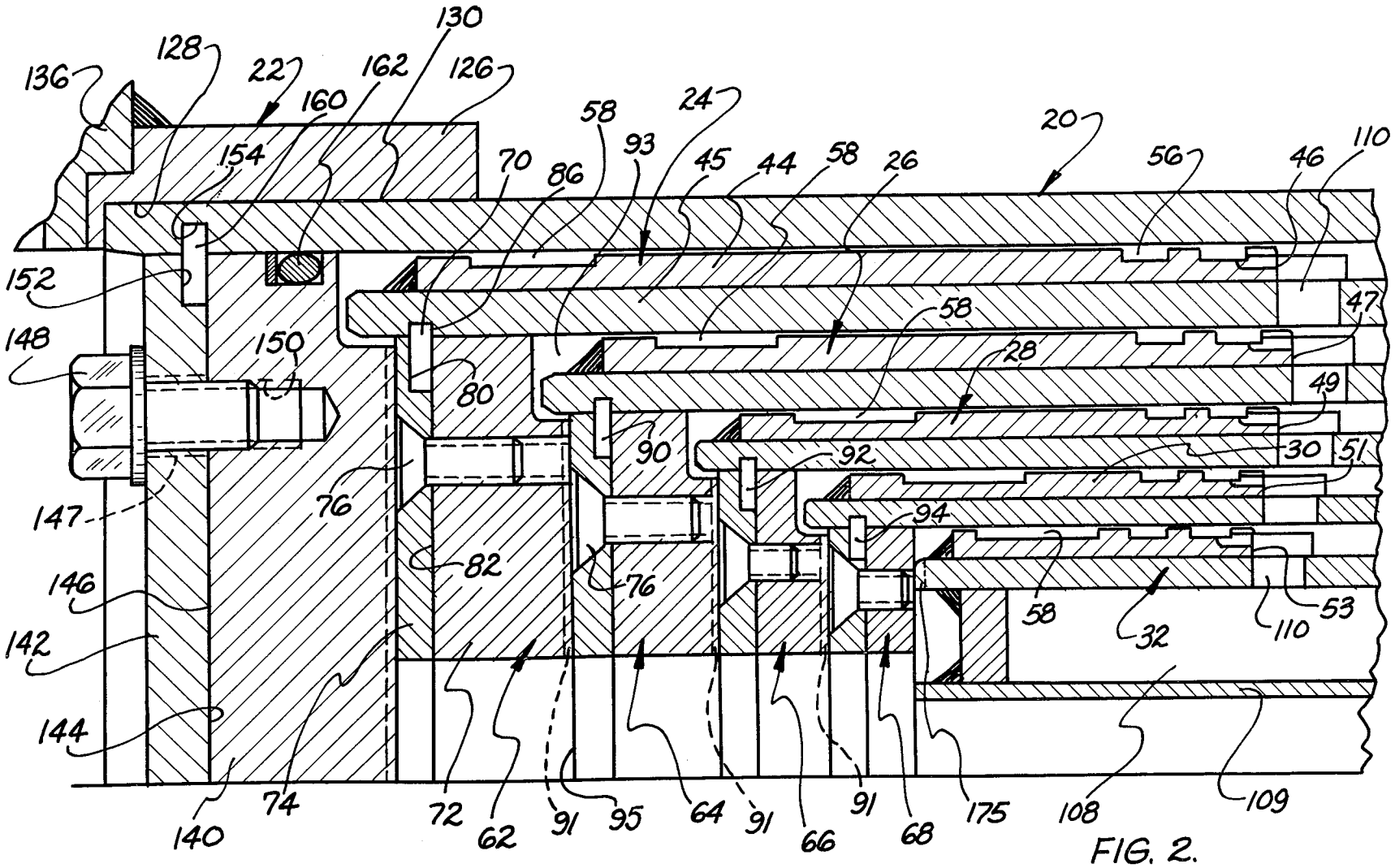
FIG. 2 is a partial enlarged sectional view corresponding to FIG. 1.
Figure 4:
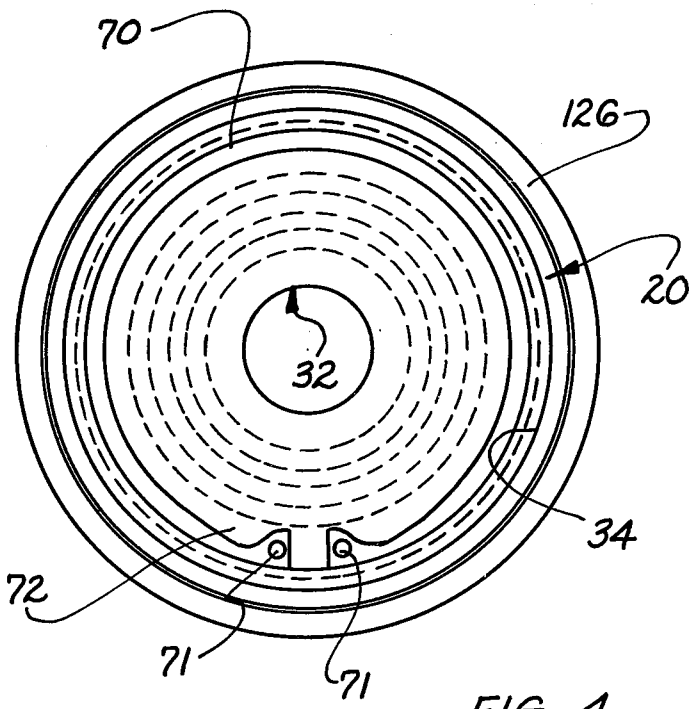
FIG. 4 is an end sectional view of the apparatus of FIG. 1, the section being taken along the line 4—4 of FIG. 1.
Figure 3:
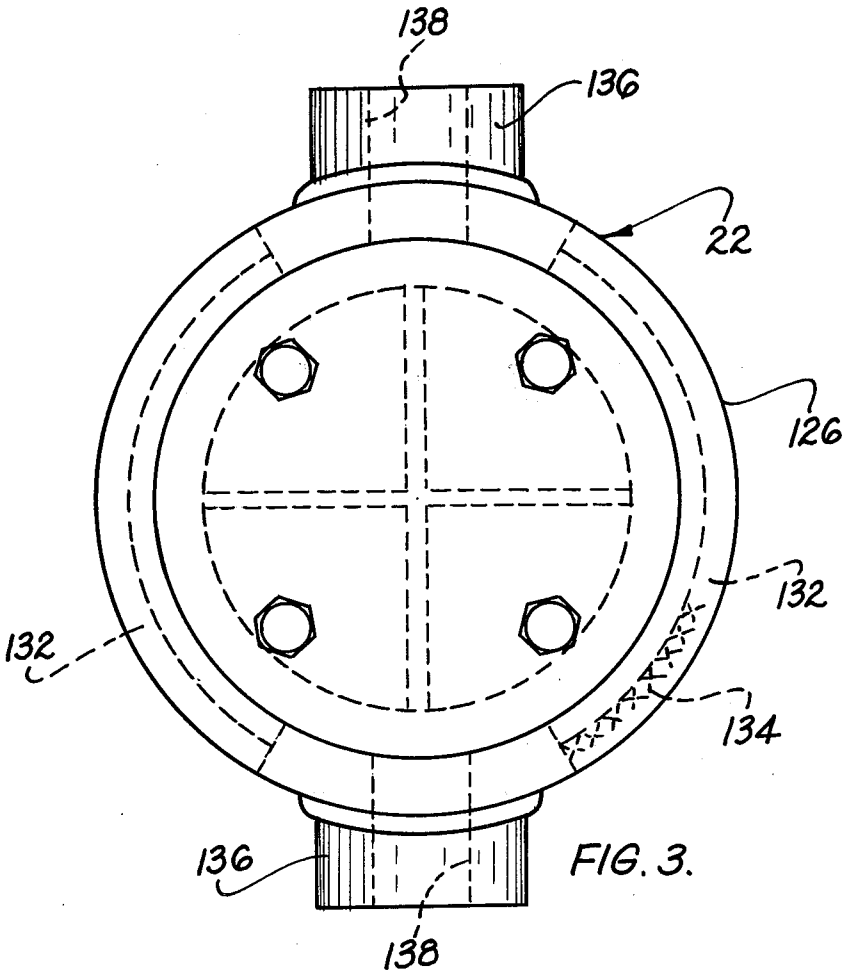
FIG. 3 is an end elevational view of the apparatus of FIG. 1.

Referring particularly to FIG. 2, each of the piston and cylinder tube assemblies 24 through 30 includes a respective transfer disc 62, 64, 66, and 68. Each transfer disc is secured to its respective cylindrical member by a snap ring such as the relatively large snap ring 70 used in the first stage.

Referring particularly to the first stage, transfer disc 62 comprises confronting disc members 72 and 74 joined together by a plurality of cap screws 76 and the surface 78 of disc member 74 is provided with an annular recess 80, which recess together with the surface 82 on disc member 72 form a slot that confronts a second annular slot 86 with said confronting slots serving to mount the previously mentioned snap ring 70.

It will now be understood that when cap screws 76 are removed the disc member 74 can be pulled outwardly from cylindrical member 45 thereby permitting removal of snap ring 70 and the inner disc member 72.

Each of the succeeding second, third, and fourth stages are of the same construction. However, here the snap rings 90, 92, and 94 are of lighter construction since they are not required to resist axial stresses as high as those imposed on the larger diameter first stage.

It should next be mentioned that oil passages 91 are provided between the confronting faces of the transfer discs 62, 64, and 66 such that oil cannot be trapped between the stages, for example, in the annular space 93 between the first and second stages. It will be understood that fluid is free to pass from the annular space 93 via oil passage 91 to a central chamber 95 formed by openings in the center of the transfer discs.

Referring next to the central ram indicated generally at 32, it should be pointed out that since the cylinder is of the double acting type it necessarily includes two oil inlet-outlet openings 102 and 104. When port 102 is pressurized fluid will flow via passage 106, annular chamber 108 and thence through the axial bores 110 to the end surfaces 46–53 of the piston sleeves of the various stages. Conversely when the other port 104 is pressurized, oil will flow via passage 112 and chamber 95 and into pressurized engagement with the annular areas formed by the other ends of the piston and cylinder assemblies.

It should now be mentioned that as each of the various stages extend beginning with first stage 24, its movement will be arrested when the respective end surface or abutment 46 on its piston sleeve 44 engages an end stop 48–55. It should be mentioned that these end stops are integrally formed by the end closures 50, 57, 59, 61 and 63 of the various stages. Also, it should be noted that the piston and cylinder tube assembly of each stage utilizes its respective piston sleeve 44 and more particularly the end thereof as the stop engaging means for arresting the movement of the particular stage. Hence the need for any separate stop ring structure is completely eliminated by the present unique construction.

It will be noted from FIG. 1 that the central ram 32 is provided with a bore 120 which forms a bearing hole for the pivot pin on the load.

Reference is next made to the construction of the previously mentioned base means 22, which comprises an annular collar 126 provided with a recess surface 128 which is sized to slide over outer surface 130 on the end of the tubular housing. Annular collar 126 is provided with arcuate slots 132 which provide access for forming weld beads 134 which secure collar 126 to the end of the cylindrical housing.

With continued reference to FIG. 1, collar 126 includes bearing bushings 136, each of which includes a bearing hole 138 for receiving a pivot pin for mounting the base of the cylinder to the load.

At this point it should be pointed out that collar 126 is secured to housing means 22 only by welds 134 which are made at the very end of the housing means and on opposite sides thereof via the access slots 132, such that the only welding between the base collar 126 and cylindrical housing 20 is remote from the machined inner surface of cylinder wall 34 of the housing means as well as remote from the operating components within the housing means.

Hence, it will be understood that the bearing surfaces and operating components are, due to the particular attaching means for the base, remote from the intense heat necessarily applied during the welding operation.

Referring particularly to FOG. 2, the base means 22 further includes an inner base plate 140 joined to an outer base plate 142 at confronting surfaces 144 and 146. The outer base plate 142 is provided with a bore 147 and a cap screw 148 is extended through the bore and into threaded engagement with a hole 150 in inner base plate 140. It will be noted that outer base plate 142 includes a recess 152 that forms an annular groove that confronts an annular groove 154 in the cylindrical member in the housing member 20. A base snap ring 160 is removably disposed in the confronting grooves 152 and 154. Hence it will be understood that when the cap screws 148 are removed then outer base plate 142 can be pulled out of the bore. The base snap ring 160 is next contracted by gripping the ring at the leg holes 71 and pulled out of the bore. Hence the inner base plate 140 is now free to be pulled out of the outer bore.

In operation, when the central passage 95 is pressurized via extension port 104, then the fluid pressure exerted on the annular surfaces of the piston and cylinder assembly will cause all of the stages to move out together. When this occurs it will be understood that the major force is exerted on the first stage 24 and such fluid force is transmitted mechanically to the next successive stages 26, 28, and 30 and thence to the central ram 32.

The first stage 22 will continue to extend until its stop-engaging shoulder 46 is arrested by stop 48 on front closure 50.

After extension of the first stage, stages two, three, four, and the center ram will start to extend and here the hydraulic stress imposed upon second stage 64 will be transmitted axially via stages three and four directly to the inner end 175 of central ram 32.

The stages will progressively extend from the central ram 32 moved to its full extension as the last movement of the assembly.

It will now be understood that due to the novel arrangement of the transfer disc 62–68 that the hydraulic forces exerted on the snap rings 70, 90, 92 and 94 are reduced to a minimum thereby permitting the use of such snap rings for the beneficial advantages of ease of fabrication and disassembly for servicing.

While the form of embodiment of the present invention as herein disclosed constitutes a preferred form, it is to be understood that other forms might be adopted.

What is claimed is:

1. A multiple stage telescoping power cylinder comprising, in combination, housing means including a tubular housing member provided with a cylindrical inner housing surface, a removable housing base means, passage means for the flow of pressurized fluid to and from said housing means to effect telescoping of said cylinder, and a housing end closure including a shoulder forming a first stage stop and a housing end opening; a first stage piston and cylinder assembly mounted in said housing means and including a first stage cylindrical member provided with a first stage inner surface extended outwardly of said housing and opening, a first stage cylindrical piston sleeve surrounding said first stage cylindrical member and including an outer sleeve surface in sliding sealed engagement with said inner housing surface, said sleeve including an end shoulder for engagement with said first stage stop, and a first stage end closure including a shoulder forming a second stage stop; a second stage piston and cylinder assembly mounted in said first stage assembly and including a second stage cylindrical member provided with a second stage inner surface extended outwardly of said first stage end opening, a second stage cylindrical piston sleeve surrounding said second stage cylindrical member and including an outer sleeve surface in sliding sealed engagement with said inner first stage surface, said sleeve including an end shoulder for engagement with said second stage stop, and a second stage end closure including a shoulder forming a third stage stop; and a ram means slideably mounted in the inner stage of the piston and cylinder tube assemblies, each of said piston and cylinder assemblies includes a base end formed of outer and inner disc members removably fastened together at confronting surfaces, a peripheral annular groove in certain of said confronting surfaces in aligned relationship with an annular groove in a respective surrounding cylindrical surface, a snap ring in said annular grooves, and a removable fastener extended through said outer disc member and in threaded engagement with said inner disc member, said fastener being removable from said base end to provide access to said snap ring whereby said snap ring and inner disc member can be removed from said base end of the piston and cylinder assembly.

2. The power cylinder of claim 1 wherein said base means includes an inner annular base member and an outer annular base member removably fastened together at confronting base member surfaces, certain of said surfaces including an annular groove confronting an annular groove in said housing means; and a snap ring removably mounted in said confronting annular grooves.

3. A multiple stage telescoping power cylinder characterized by housing means including a removable housing base means and a housing end closure forming a first stage stop; a plurality of telescoping piston and cylinder assemblies in said housing means in surrounding relationship with a central ram, each of said assemblies including a cylindrical member provided with an end closure forming a stop for the next inward assembly, each of said piston and cylinder assemblies includes a base end formed of outer and inner disc members removably fastened together at confronting surfaces, a peripheral annular groove in certain of said confronting surfaces in aligned relationship with an annular groove in a respective surrounding cylindrical surface, a snap ring in said annular grooves, and a removable fastener extended through said outer disc member and in threaded engagement with said inner disc member, said fastener being removable from said base end to provide access to said snap ring whereby said snap ring and inner disc member can be removed from said base end of the piston and cylinder assembly.

4. A telescoping type power cylinder comprising, in combination, an outer tubular housing means including a housing inner wall, a housing base end provided with a housing base opening, and a housing outer end provided with a housing outer opening; base means removably mounted on said housing base end and forming a closure for said base opening, said base means being removable from said base end to provide access through said base opening to the interior of said outer tubular housing means; a first stage piston and cylinder tube assembly including a first stage cylindrical member slideably mounted in said housing inner wall and including a first stage inner wall, a first stage base end provided with a first stage base opening, a first stage outer end provided with a first stage outer opening; a first stage transfer disc removably mounted on said first stage base end, said first stage transfer disc and base including confronting annular grooves; a first stage snap ring removably mounted in said confronting annular grooves; a second stage piston and cylinder tube assembly including a second stage cylindrical member slideably mounted in said housing inner wall and including a second stage inner wall, a second stage base end provided with a second stage base opening, a second stage outer end provided with a second stage outer opening; a second stage transfer disc removably mounted on said second stage base end, said second stage transfer disc and base end including confronting annular grooves; a second stage snap ring removably mounted in said confronting annular grooves, each of said transfer discs of each of said stages including inner and outer disc portions removably fastened together at confronting disc surfaces by threaded fasteners, said fasteners being accessible and removable through said base openings, one of said confronting annular grooves being formed by said confronting disc surfaces; and a third stage ram means including an outer wall slideably mounted in said second stage inner wall, an inner ram end, and an outer ram end, said transfer discs of said first and second stage cylindrical members being positioned in axially aligned contiguous force transmitting relationship with one another and with said inner ram end.

5. The power cylinder defined in claim 4 that includes means forming a pressure release passage for the flow of fluid between the cylindrical members and a central chamber when the transfer discs are in said contiguous relationship.

6. The power cylinder defined in claim 4 wherein said tubular housing means and base means include confronting annular grooves; and a snap ring removably mounted in said confronting annular grooves.

7. The power cylinder defined in claim 4 wherein said base means includes an inner annular base member and an outer annular base member removably fastened together at confronting base member surfaces, certain of said surfaces including an annular groove confronting an annular groove in said housing means; and a snap ring removably mounted in said confronting annular grooves.

8. A multiple stage telescoping power cylinder characterized by housing means including a housing base opening; a housing base means removably covering said base opening to provide access to the telescoping stages within said housing means; a plurality of telescoping piston and cylinder assemblies in said housing means and surrounding a central ram, each of said assemblies including a cylindrical member, transfer disc means on one end of the cylindrical member, and a snap ring disconnectably mounting said transfer disc means to said cylindrical member, said transfer disc means including inner and outer disc portions, and threaded fasteners accessible from said housing base opening removably securing said disc portions together at confronting disc surfaces, one of said annular grooves being formed by said confronting disc surfaces to permit access to and removal of said snap ring upon removal of said threaded fasteners.

9. The power cylinder of claim 8 wherein said housing base means includes inner and outer base plates joined together at confronting base surfaces, a base snap ring retained between said base surfaces and extended into a groove in said housing means; and threaded fasteners accessible from said housing base opening removably securing said base plates together to permit access to and removal of said base snap ring.

* * * * *